US009278568B2

(12) United States Patent
Yuno

(10) Patent No.: US 9,278,568 B2
(45) Date of Patent: Mar. 8, 2016

(54) STAMP-FACE FORMING APPARATUS, METHOD OF FORMING A STAMP FACE, AND STAMP-FACE FORMING SYSTEM

(71) Applicant: CASIO COMPUTER CO., LTD., Shibuya-ku, Tokyo (JP)

(72) Inventor: Hirotaka Yuno, Hiratsuka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/534,052

(22) Filed: Nov. 5, 2014

(65) Prior Publication Data

US 2015/0122141 A1 May 7, 2015

(30) Foreign Application Priority Data

Nov. 6, 2013 (JP) ..... 2013-229893

(51) Int. Cl.

| | |
|---|---|
| ***B41J 2/32*** | (2006.01) |
| ***B41K 3/62*** | (2006.01) |
| ***B41K 1/50*** | (2006.01) |
| ***B41J 2/355*** | (2006.01) |
| ***B41C 1/055*** | (2006.01) |

(52) U.S. Cl.

CPC . *B41K 3/62* (2013.01); *B41C 1/055* (2013.01); *B41J 2/32* (2013.01); *B41J 2/355* (2013.01); *B41K 1/50* (2013.01)

(58) Field of Classification Search

CPC ..... B41K 3/62; B41K 1/02; B41K 1/50; B41C 1/055; B41M 5/0052; B41M 5/0064; B41J 2/32; B41J 2/315; B41J 2/355

USPC ..... 101/333, 401.1; 400/120.01; 347/188

See application file for complete search history.

(56) References Cited

U.S. PATENT DOCUMENTS 6,163,329 A * 12/2000 Venkataraman ..... B41C 1/055 101/327

2007/0074822 A1 4/2007 Akechi

FOREIGN PATENT DOCUMENTS

| | | | |
|---|---|---|---|
| JP | 05085065 | A | 4/1993 |
| JP | 06061925 | B2 | 8/1994 |
| JP | 10100464 | A | 4/1998 |
| JP | 2000118109 | A | 4/2000 |
| JP | 2006316078 | A | 11/2006 |

* cited by examiner

*Primary Examiner* — Leslie J Evanisko

(74) *Attorney, Agent, or Firm* — Holtz, Holtz & Volek PC

(57) ABSTRACT

A stamp-face forming apparatus is provided for forming a stamp face. The apparatus has a stamp-face forming unit which is provided with plural heating elements disposed so as to face a surface of a stamp face material, and forms the stamp face on the stamp face material, the stamp face material includes porous material which can be non-porous when heated, and the stamp face material is detachably held in a holding body and is at least partially coated with a film. Further, the apparatus has a controlling unit for controlling the stamp-face forming unit such that an amount of heat per unit area to be applied to a part of the film facing at least one edge portion of the stamp face material is larger than an amount of heat per unit area applied to apart of the film facing the other portion of the stamp face material to be non-porous.

20 Claims, 10 Drawing Sheets

STAMP-FACE FORMING APPARATUS, METHOD OF FORMING A STAMP FACE, AND STAMP-FACE FORMING SYSTEM

CROSS-REFERENCE TO RELATED APPLICATION

The present application is based upon and claims the benefit of priority from the prior Japanese Patent Application No. 2013-229893, filed Nov. 6, 2013, the entire contents of which are incorporated herein by reference.

BACKGROUND OF THE INVENTION

1. Field of the Invention

The present invention relates to a stamp-face forming apparatus, a method of forming a stamp face, and a stamp-face forming system, which form a stamp face on a stamp face material held in a stamp-face material holder.

2. Description of the Related Art

Saving troublesome work to put ink on a stamp face of a stamp every time a user fixes his/her stamp, rubber stamps have been used widely, which use a porous sponge sheet previously impregnated with ink as a stamp face.

For example, Japanese Unexamined Patent Publication No. Hei 10-100464 has proposed a plate making apparatus for forming a stamp face. The plate making apparatus is provided with a thermal head having plural heating elements. A stamp produced by this plate making apparatus consists of a block with a stamp face material (stamp plate) attached thereon, wherein the stamp face material is made of a porous sheet. While making the stamp plate, the plate making apparatus holds the block with the stamp face material attached thereon and moves the plural heating elements of the thermal head so as to slide on the surface of the porous sheet of the stamp face material, while resiliently pressing the heating elements against the surface of the porous sheet, and selectively heats the plural heating elements to heat the stamp face material, thereby making non-porous portions preventing ink from permeating there through and porous portions allowing ink to permeate there through. In this way, the plate making apparatus forms a stamp face consisting of the non-porous portions preventing ink from permeating there through and the porous portions allowing ink to permeate there through.

In the plate making apparatus disclosed by Japanese Unexamined Patent Publication No. Hei10-100464, the stamp consists of the block with the stamp plate made of a square stamp material sheet, attached thereon, and the plate making apparatus makes the stamp plate while the stamp plate is attached to the block, and therefore, the plate making apparatus has to be large in scale.

SUMMARY OF THE INVENTION

According to one aspect of the invention, there is provided a stamp-face forming apparatus for forming a stamp face, which comprises a stamp-face forming unit which is provided with plural heating elements disposed so as to face a surface of a stamp face material, and forms the stamp face on the stamp face material, wherein the stamp face material includes porous material which can be non-porous when heated, the stamp face material is detachably held in a holding body and is at least partially coated with a film, and a controlling unit which controls the stamp-face forming unit such that an amount of heat per unit area to be applied to a part of the film facing at least one of edge portions of the stamp face material is larger than an amount of heat per unit area applied to a part of the film facing a portion of the stamp face to be non-porous.

According to another aspect of the invention, there is provided a method of forming a stamp face on a stamp face material, in a stamp-face forming apparatus which is provided with a stamp-face forming unit, the stamp-face forming unit having plural heating elements for heating the stamp face material to form the stamp face thereon, the stamp face material includes porous material which can be non-porous when heated, wherein the stamp face material is detachably held in a holding body and is at least partially coated with a film, and a conveyed object includes the stamp face material, the holding body and the film, the method which includes a step of conveying the conveyed object to pass through the stamp-face forming unit such that the surface of the stamp face material is in contact with the plural heating elements of the stamp-face forming unit, thereby forming a stamp face on the stamp face material, and a step of controlling the amount of heat to be applied from the heating elements to the film while the heating elements form a stamp face on the stamp face material, such that the amount of heat per unit area to be applied to a part of the film facing at least one of edge portions of the stamp face material is larger than the amount of heat per unit area applied to a part of the film facing a portion of the stamp face to be non-porous.

According to other aspect of the invention, there is provided a stamp-face forming system which comprises a stamp-face forming apparatus and a computer apparatus, wherein the stamp-face forming apparatus is for forming a stamp face on a stamp face material and comprises a stamp-face forming unit which is provided with plural heating elements disposed so as to face a surface of the stamp face material, and forms the stamp face on the stamp face material, wherein the stamp face material includes porous material which can be non-porous when heated, and the stamp face material is detachably held in a holding body and is at least partially coated with a film, and a conveyed object includes the stamp face material, the holding body and the film, a communication unit which communicates with the computer apparatus, and a controlling unit which controls the stamp-face forming unit based on data received by the communication unit, such that the amount of heat per unit area to be applied to a part of the film facing at least one of edge portions of the stamp face material is larger than the amount of heat per unit area applied to a part of the film facing a portion of the stamp face to be non-porous, wherein the computer apparatus comprises an image data producing unit which selects a stamp face material and produces or selects image data for forming a stamp face on the selected stamp face material by heating, an additionally-heating data producing unit which produces additionally-heating data used for heating the stamp face material such that the amount of heat per unit area to be applied to a portion close to the one of the edge portion of the stamp face material is larger than the per unit area applied to other portion of the stamp face material, and superimposes the additionally-heating data on the image data for forming a stamp face, thereby superimposing the produced additionally-heating data on the image data produced by the image data producing unit, and an outputting unit which outputs the superimposed image-data to the communication unit of the stamp-face forming apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter,

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principle of the invention.

DETAILED DESCRIPTION OF THE PREFERRED EMBODIMENTS

<<Definitions of General Idea and Terms>>

Figure 1A:
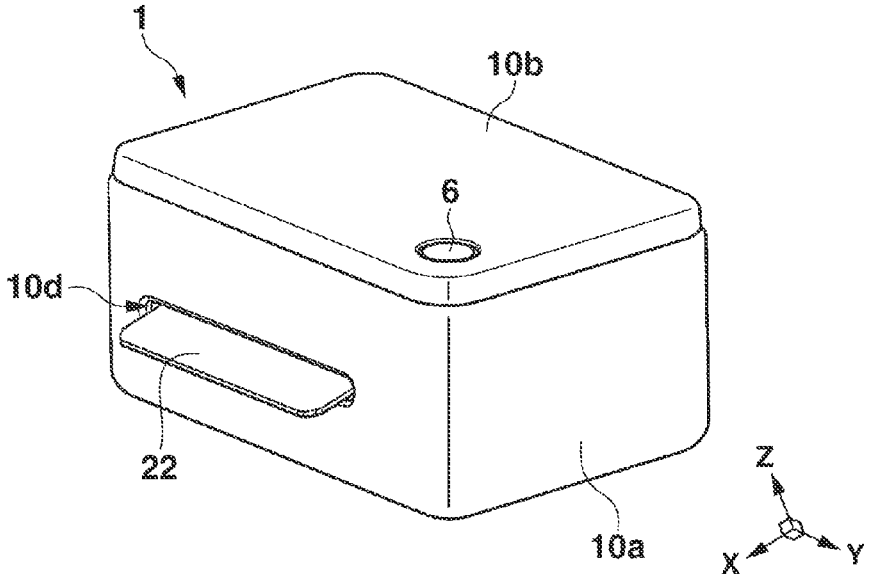
FIG. 1A is a perspective view showing an external appearance of a stamp-face forming apparatus with a stamp-face material holder installed therein, according to the embodiment of the invention.

Before describing embodiments of the invention, important general idea and terms used hereinafter will be defined in detail.

A stamp-face forming apparatus is equipment for forming a pattern on stamp-face material to produce a stamp face. In the embodiments of the invention, a so-called thermal printer can be used. The thermal printer has a thermal head which is provided with plural heating elements and a driving circuit for selectively driving the heating elements to heat the same elements.

The stamp face material is material of thermo-plasticity, made of porous sponge body absorbing liquid ink, which material will be non-porous when heated. For example, a porous ethylene-vinyl acetate copolymer (EVA) can be used as the stamp face material.

A stamp-face material holder is a tool used to bring the stamp face material to the stamp-face forming apparatus to form the pattern on the stamp face material. For example, the stamp face material holder with the stamp face material held thereon is provided to a user of the stamp-face forming apparatus. In the present description, for convenience, it is assumed that the stamp face holder has the stamp face material, a holding body for holding the stamp face material, and a film for protecting the stamp face material. The stamp face material holder is sometimes referred to as a "conveyed body" or a "conveyed object".

For example, the holding body is made of paperboard or cardboard. This holding body is disposed after the stamp face has been formed on the stamp face material and the stamp face material has been removed from the stamp-face material holder.

For example, the film is made of a base material such as PET and/or polyimides, and is enhanced in heat resistance, thermal conductivity and surface smoothness, serving as a protector for protecting the stamp face material when the stamp face is formed.

A stamp-face forming unit is a mechanism for selectively heating the surface of the stamp face material with the thermal head to make the surface of the stamp face material non-porous, preventing the ink from passing there through.

A printing operation in the following description is not a conventional printing operation using ink but means a process of selectively heating the plural heating elements of the thermal head in accordance with image data to determine whether each of dots of a prescribed size composing the surface of the stamp face material is made non-porous or not.

A conveying unit is a mechanism for conveying the stamp-face material holder, and, for example, can be composed of platen rollers and stepping motors for driving the platen rollers.

The edge of the stamp face material is the side surface of the stamp face when it is assume that the stamp face material is a rectangular parallelepiped. A portion abutting against the edge of the stamp face material is a portion of the film coalescing to the edge of the stamp face material.

Overheating means heating the film until the film deteriorates its durability and becomes easy to break.

A controlling unit is a controlling unit (CPU) of the stamp-face forming apparatus. The controlling unit (CPU) of the stamp-face forming apparatus is connected to a personal computer (PC), a smartphone, and/or a tablet computer through a wire communication (USB, Registered Trademark), a wireless communication (Wi-Fi, Registered Trademark), Bluetooth (Registered Trademark) and/or WLAN (Registered Trademark) to cooperate with them. When the controlling unit (CPU) of the stamp-face forming apparatus is connected to cooperate with other computer, the stamp-face forming apparatus and the computer are referred to as a "stamp-face forming system".

A conveying rate is a rate at which the conveying unit conveys the stamp-face material holder.

When the stamp face material held in the stamp-face material holder is delivered to the user, the stamp face material is coated with the film at a factory where the stamp-face material holder is produced.

A stamp-face forming process is performed to control heating so as to allow the stamp face material to be easily removed from the stamp-face material holder after the stamp face forming has been completed.

<<Essence of the Invention>>

The subject of the invention is to provide a stamp-face forming apparatus, a method of forming a stamp face, and a stamp-face forming system for forming a stamp face while the stamp face material is held in the stamp-face material holder. In particular, the invention relates to a process of controlling heating so as to allow the stamp face material to be easily removed from the stamp-face material holder after the stamp face forming has been completed.

Hereinafter, the stamp-face forming apparatus according to the embodiments of the invention will be described with reference to the accompanying drawings in detail.

<<Mechanical Structure of Stamp-Face Forming Apparatus>>

Figure 1B:
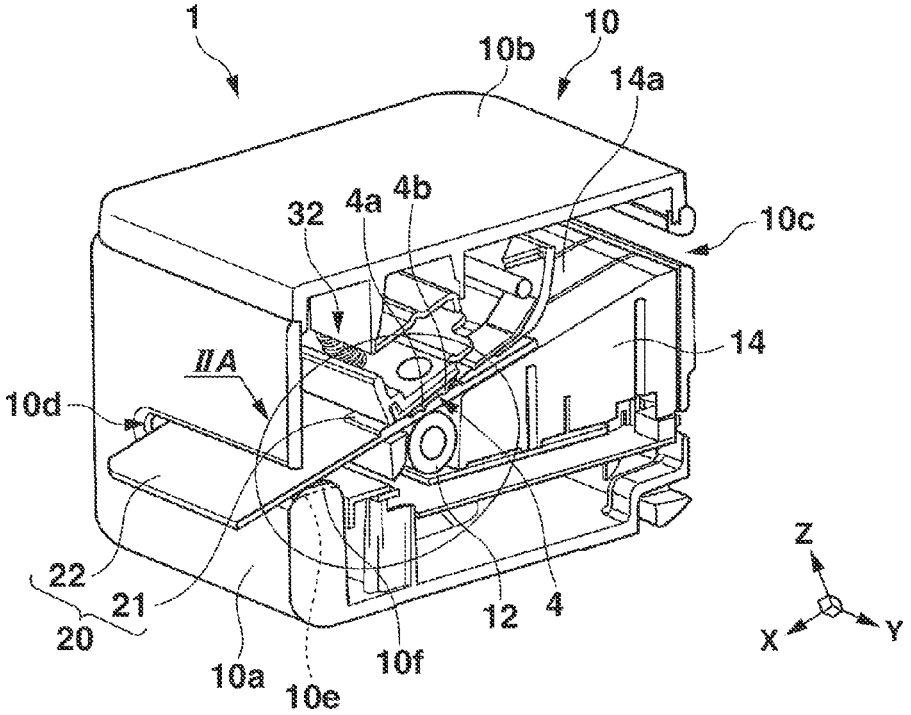
FIG. 1B is a cross section view showing the mechanical structure of the stamp-face forming apparatus along the X-Z plane.
Figure 2A:
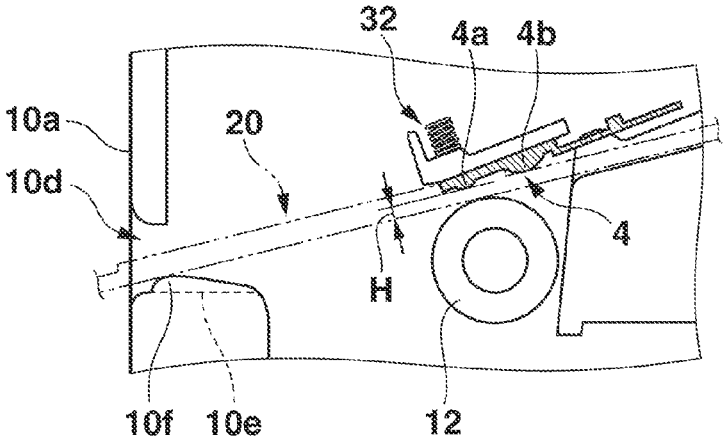
FIG. 2A is across section view showing the main structure of the vicinity of an outlet of the stamp-material holder of the stamp-face forming apparatus, shown at IIA in FIG. 1B.
Figure 2B:
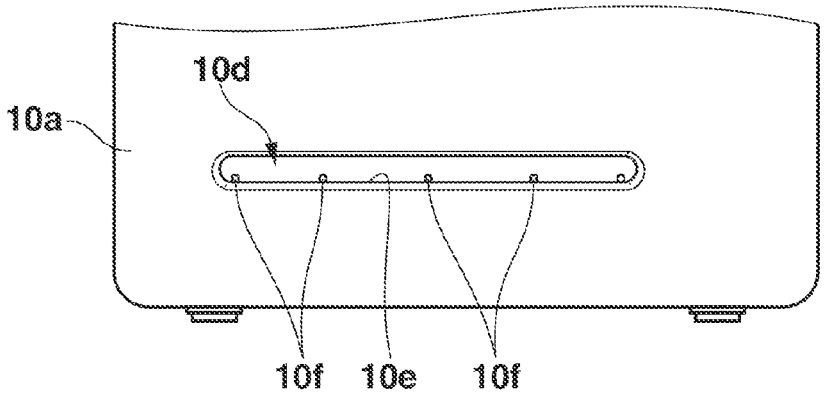
FIG. 2B is a front view showing the external appearance of the stamp-face forming apparatus including the outlet for the stamp-face material holder.
Figure 3:
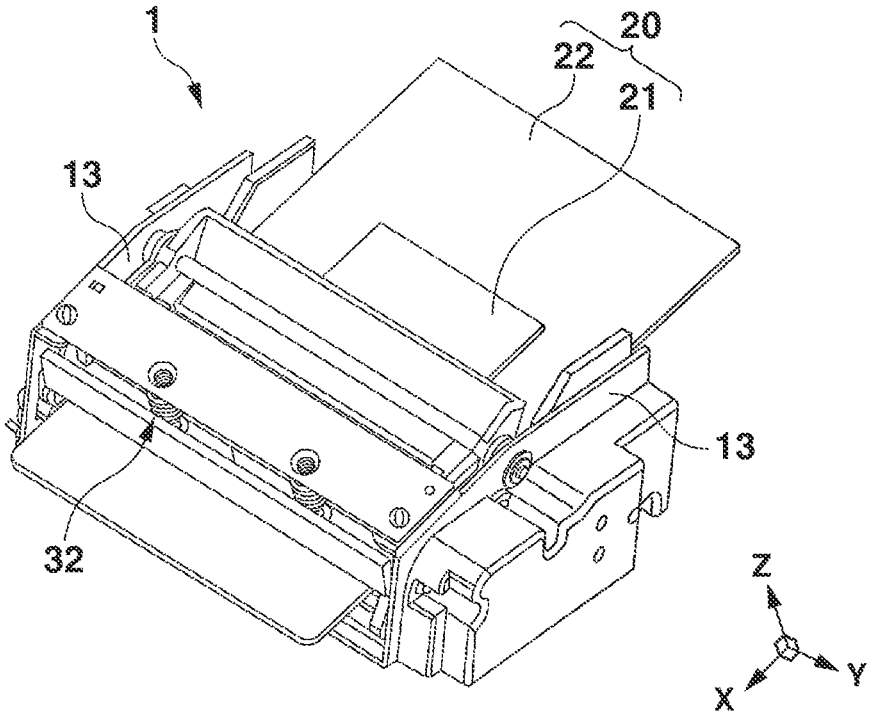
FIG. 3 is a perspective view illustrating the main portion of a stamp-face forming unit employed by the stamp-face forming apparatus according to the embodiment of the invention.
Figure 4A:
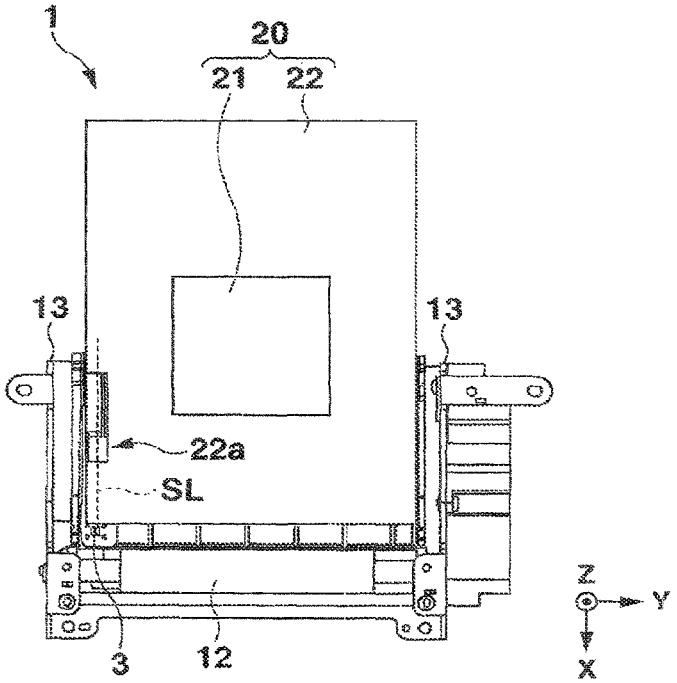
FIG. 4A is a plan view illustrating the main portion of the stamp-face forming unit used in the stamp-face forming apparatus according to the embodiment of the invention.
Figure 4B:
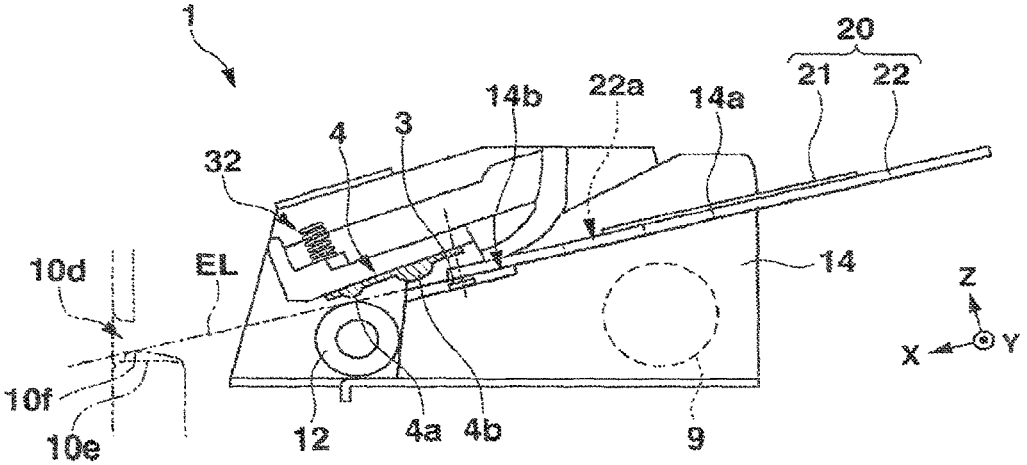
FIG. 4B is a cross section view illustrating the main portion of the stamp-face forming unit of the stamp-face forming apparatus taken along the vertical plane in the conveyed direction.

FIG. 1A and FIG. 1B are perspective views schematically illustrating the stamp-face forming apparatus with the stamp-face material holder according to one embodiment of the invention. FIG. 1A is a perspective view showing an external appearance of the stamp-face forming apparatus according to the embodiment of the invention. FIG. 1B is a cross section view showing the mechanical structure of the stamp-face forming apparatus along the X-Z plane. FIG. 2A and FIG. 2B are schematic views showing the vicinity of an outlet for the stamp-face material holder used in the stamp-face forming apparatus according to the embodiment of the invention. FIG. 2A is a cross section view showing the main structure of the vicinity of an outlet for the stamp-material holder used in the stamp-face forming apparatus, shown at IIA in FIG. 1B. FIG. 2B is a front view showing the external appearance of the stamp-face forming apparatus including the outlet for the stamp-material holder. FIG. 3 is a perspective view illustrating the main portion of a stamp-face forming unit used in the stamp-face forming apparatus according to one embodiment of the invention. FIG. 4A is a plan view illustrating the main portion of the stamp-face forming unit used in the stamp-face forming apparatus according to the embodiment of the invention. FIG. 4B is a cross section view illustrating the main portion of the stamp-face forming unit of the stamp-face forming apparatus taken along the vertical plane in a conveyed direction. FIG. 4A is a plan view of the stamp-face forming unit and FIG. 4B is a cross section view showing the stamp-face forming unit taken along X-Z plan.

The stamp-face forming apparatus (hereinafter, sometimes referred to as the "printer") 1 according to the embodiment of the invention is a so-called a thermal printer. In the stamp-face forming apparatus (thermal printer) shown in FIG. 1A and FIG. 1B, the stamp-face material holder 20 is entered into an insertion opening 10*c* and conveyed to the outlet 10*d*. As the detail of the stamp-face material holder 20 will be described with reference to FIG. 6A to FIG. 6C later, the stamp-face material holder 20 consists of the stamp face material 21, the holding body 22 for holding the stamp face material 21, and the film 24 for protecting the stamp face material 21. The printer 1 presses the thermal head 24 onto the stamp face material 21 held by the stamp-face material holder 20 with prescribed load with the film 24 held between the thermal head 24 and the stamp face material 21, and selectively heats the plural heating elements of the thermal head 4, thereby forming a stamp face representing a pattern (character(s), symbol(s), figure(s) and the like) on the stamp face material 21 held by the stamp-face material holder 20. The stamp face is a portion which generates a stamp impression consisting of character(s), symbol(s), figure(s) and the like, when a stamp is affixed.

As shown in FIG. 1A and FIG. 1B, X-, Y- and Z-directions which are perpendicular to each other are set. In FIG. 1A and FIG. 1B, the directions indicated by arrows are indicated by a sign of "+", and the opposite directions are indicated by a sign of "−". When both directions are indicated, no sign is given. The X-direction is same as the direction in which the stamp-face material holder 20 holding the stamp face material 21 for forming a stamp face is conveyed, and is sometimes referred to as the "front-rear" direction. The Y-direction is same as the width direction of the printer 1, and is sometimes referred to as the "left-right" direction. The Z-direction is same as the direction in which the thermal head 4 is pressed against the stamp-face material holder 20, and is sometimes referred to as the "up-down" direction.

As shown in FIG. 1A and FIG. 1B, the printer 1 is provided with a case 10 consisting of a top and bottom cases 10*b*, 10*a*. Further, the bottom case 10*a* is provided with the insertion opening 10*c* and the outlet 10*d* on its front and rear walls, respectively, for allowing the stamp-face material holder 20 to pass through. On the top of the top case 10*b*, there is provided an input operation unit 6. When a user operates the input operation unit 6, a signal is generated in accordance with the operation performed by the user.

For example, as shown in FIG. 2A and FIG. 2B, on the lower portion 10*e* inside the outlet 10*d* of the bottom case 10*a*, there are provided plural ribs (supports) 10*f* of a prescribed height at prescribed intervals in the Y-direction toward the opening. The plural ribs 10*f* are disposed on a conveyance path of the stamp-face material holder 20 discharged from the outlet 10*d*. In other words, the plural ribs 10*f* are arranged to contact with and support the bottom surface of one end (the +X-direction) of the stamp-face material holder 20, when the stamp-face material holder 20 is entered from the insertion opening 10*c* and conveyed into inside the printer 1 and at least at the time when a state in which the thermal head 4 is pressed against the stamp-face material holder 20 has been changed to a specific state. The plural ribs 10*f* are arranged to contact with the bottom surface of the stamp-face material holder 20 to prevent the stamp-face material holder 20 from being curved when the thermal head 4 is pressed against the stamp-face material holder 20. More preferable, the plural ribs 10*f* are provided such that the ribs 10*f* do not give any effect to conveyance of the stamp-face material holder 20, in other words, the plural ribs 10*f* are provided to support the stamp-face material holder 20 with least friction.

For example, a stamp-face forming unit embedded in the case 10 of the printer 1 comprises the thermal head (stamp-face forming unit) 4, a stepping motor 9, a guide 14, a platen roller (conveyance roller) 12, as shown in FIG. 3, FIG. 4A, and FIG. 4B. There are provided a pair of side frames 13, 13, facing to each other in the Y-direction, on both sides of the thermal head 4, the guide 14 and the platen roller 12.

As shown in FIG. 4A and FIG. 4B, the platen roller 12 serves to convey the stamp-face material holder 20 in the X-direction. The platen roller 12 is provided and supported between the side frames 13, 13, and has a shaft whose ends penetrating the side frames 13, 13. The both ends of the shaft of the platen roller 12 are rotatably supported by the side frames 13, 13. A roller gear (not shown) is integrally mounted on a rotary shaft (end of +Y shaft) of the platen roller 12, which gear is engaged with a driving gear (not shown) of a driving shaft of the stepping motor 9. When the stepping motor 9 rotates, the driving force of the stepping motor 9 is transferred to the platen roller 12 via the driving gear, whereby the platen roller 12 rotates at a prescribed rotary rate.

The guide 14 has an inclined plane 14*a* for guiding the stamp-face material holder 20 (stamp face material 21) to the platen roller 12. The inclined plane 14*a* is disposed such that an extended line EL (indicated by a dashed line, conveyance path) of the inclined plane 14*a* will contact with the external peripheral surface of the platen roller 12, as shown in FIG. 4B. The projection height, shape, and disposition of ribs 10*f* provided on the lower portion 10*e* of the outlets 10*d* are arranged such that the tops of the ribs 10*f* will contact with the extended line EL of the inclined plane 14*a*, as shown in FIG. 4B.

A sensor 3 is provided in a recess 14*b* of the inclined plane 14*a*, as shown in FIG. 4B. The sensor 3 is disposed in the back of the recess 14*b* such that the sensor 3 does not contact with the stamp-face material holder 20 when the stamp-face material holder 20 is conveyed along the conveyance path. As shown in FIG. 4A, the sensor 3 is disposed approximately at a position on the +Y-side of the left side frame 13 and on the −X-side of the platen roller 12 such that a notch 22*a* of the stamp-face material holder 20 will pass through over the sensor 3. A detection scanning line SL indicated by a broken line in FIG. 4A is a line which intersects with the optical axis of the sensor 3 and extends in the X-direction. The sensor 3 is a reflection type optical sensor comprising a light emitting element and a light receiving element, wherein the light emitting element emits light in the +Z-direction and the light receiving element receives the light reflected on the object (stamp-face material holder 20) in the −Z-direction. The sensor 3 generates a signal in accordance with a light volume received by the light receiving element. A sort (size) of the stamp face material 21 embedded in the stamp-face material holder 21 is specified based on the signal.

The thermal head 4 is mounted so as to face the platen roller 12 as shown in FIG. 2A and FIG. 4B. The thermal head 4 is resiliently pressed against the stamp face material 21 in the stamp-face material holder 20 conveyed in the X-direction with the film 24 held between the thermal head 4 and stamp face material 21. A pressing portion 4*a* of the thermal head 4 for pressing the stamp face material 21 is made belt-like and extending in the Y-direction. The length (in the Y-direction) of the pressing portion 4*a* is longer than the width of the stamp face material 21. Therefore, when pressed evenly by the pressing portion 4*a* of the thermal head 4, a belt type portion of the stamp face material 21, extending in the Y-direction will be deformed. The plural heating elements (not shown), which are selectively heated when a stamp face is formed, are arranged on the pressing portion 4*a* in the Y-direction. The thermal head 4 is provided with IC chip (driver IC) 4*b*. The driver IC 4*b* has a driving circuit for controlling a heating state of each of the plural heating elements arranged on the pressing portion 4*a*. The driver IC 4*b* is disposed at a position opposite to the pressing portion 4*a* having the plural heating elements, when the direction (−X-direction) in which the stamp-face material holder 20 is conveyed is seen in FIG. 4B. Using the thermal head 4 having the structure described above, the belt-like portion of the stamp face 21 (which is pressed by the pressing portion 4*a* of the thermal head 4 to be subjected to deformation) is heated at the portions corresponding to the plural heating elements of the thermal head 4.

In conventional thermal heads (4), the pressing portion (4*a*) having plural heating elements and the driver IC (4*b*) for controlling heating states of the heating elements are closely disposed on one surface of a printed circuit board (PCB). This structure is for reducing the size of the printed circuit board and also for suppressing increasing the manufacturing cost of the thermal head. This structure is employed in most thermal heads.

A distance H (indicated in FIG. 2A) between the thermal head 4 and the platen roller 12 can be set to a prescribed value in accordance with the structure of the stamp-face material holder 20. Further, it is possible to provide a mechanism (32 in FIG. 2A) which moves the thermal head 4 or the platen roller 12 in the Z-direction to adjust the distance H between the thermal head 4 and the platen roller 12. Employing the mechanism 32 for adjusting the distance H between the thermal head 4 and the platen roller 12, it is possible to change pressing force to be applied by the thermal head 4 onto the stamp face material 21. In particular, when the stamp face materials 21 of different sizes (different widths) are used to form a stamp face on the stamp-face material holder 20, a pressing state by the pressing portion 4*a* of the thermal head 4 can change depending on the size of the stamp face materials 21. Therefore, it is very useful to use the mechanism 32 for adjusting the distance H between the thermal head 4 and the platen roller 12 for forming an appropriate stamp face. In the mechanism 32, the distance H is adjusted based on the size of the stamp face material 21 on the stamp-face material holder 20, which is specified by the controlling unit 2, for example, when the sensor 3 scans the notch of the stamp-face material holder 20. The shorter the distance H is set, the larger the pressing force will be applied onto the stamp face material 21 by the thermal head 4.

<<Configuration of Stamp-Face Forming Apparatus>>

Now, the functional configuration of the printer 1 according to the present embodiment of the invention, that is, the functions controlled by the controlling unit (CPU) will be described.

Figure 5:
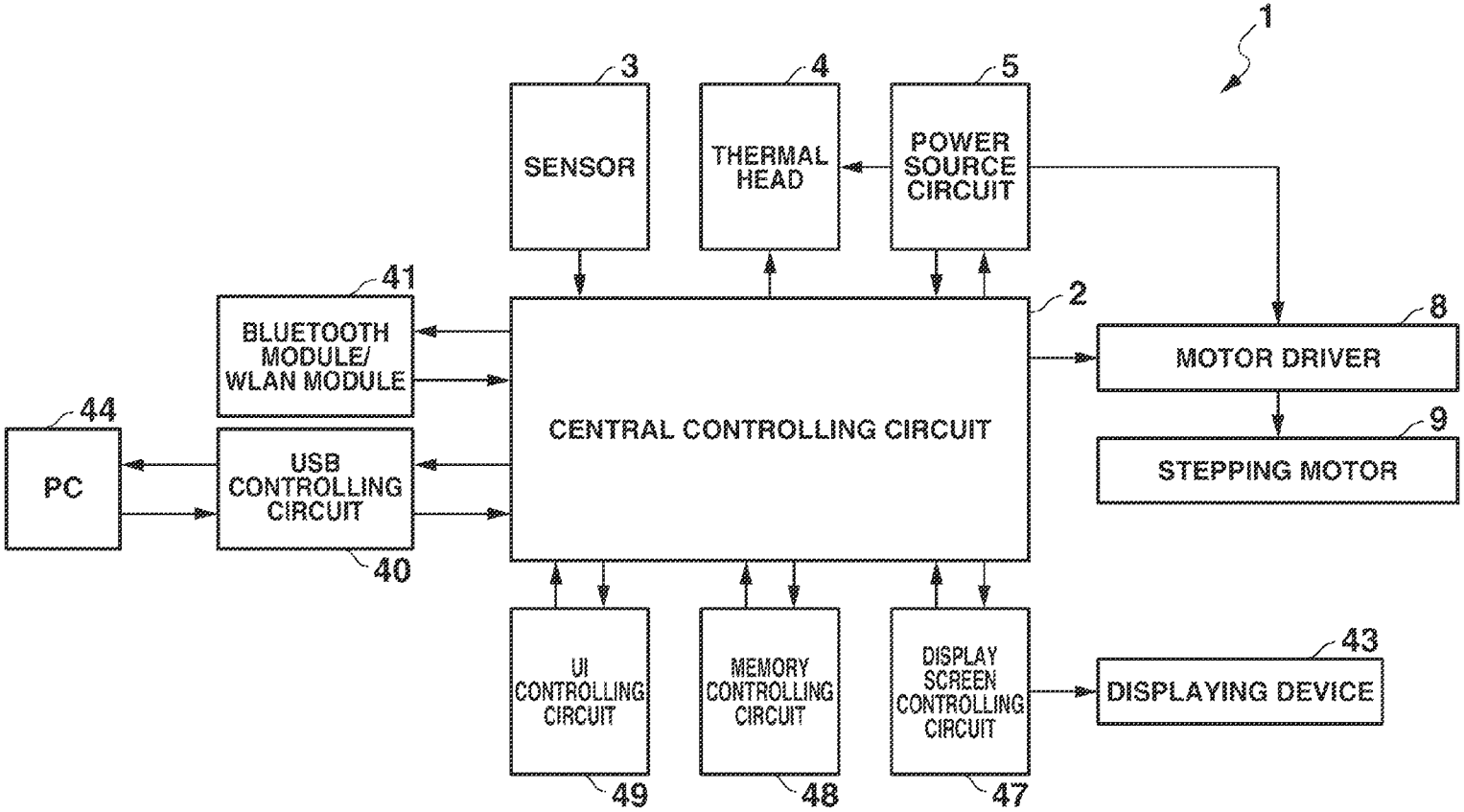
FIG. 5 is a block diagram of a system configuration of the stamp-face forming apparatus (printer) 1 according to the present embodiment of the invention.

FIG. 5 is a block diagram of a system configuration of the stamp-face forming apparatus (printer) 1 according to the present embodiment of the invention.

As shown in FIG. 5, the printer 1 has a central controlling circuit 2. Further, the central controlling circuit 2 comprises the sensor 3, the thermal head 4, a power source circuit 5, a motor driver 8, a display screen controlling circuit 47, a memory controlling circuit 48, a UI (user interface) controlling circuit 49, a USB controlling circuit 40, and a Bluetooth (registered trademark) module • wireless LAN module 41. The stepping motor 9 is connected to the motor driver 8. A displaying device 43 is connected to the display screen controlling circuit 47. A personal computer (PC) 44 is connected to USB controlling circuit 40.

In the present embodiment, the reflection type optical sensor is used as the sensor 3. Further, in the present embodiment, all of the displaying device 43, the display screen controlling circuit 47, UI (user interface) controlling circuit 49, USB controlling circuit 40, and Bluetooth (registered trademark) module • wireless LAM module 41 are not always essential elements.

In FIG. 5, the central controlling circuit 2 controls the operation of the whole system. In FIG. 5, the elements shown therein are connected only to the central controlling circuit 2, but are connected to each other for exchanging data through a bus line. The central controlling circuit 2 includes CPU (Central Processing Circuit), and reads and runs a computer program to execute various functions such as detecting a conveyance amount, setting a size, calculating a size, detecting a position, controlling a heating state, and controlling a pressing force.

The memory controlling circuit 48 includes devices such as ROM (Read Only Memory) and RAM (Random Access Memory), and controls these devices. The displaying device 43 is a displaying device such as LCD (Liquid Crystal Display), and the display screen controlling circuit 47 controls data transferring to the displaying device 43 and turning on/off of the back light of the displaying device 43.

The computer programs required for realizing various functions are stored in ROM and are written in RAM and referred to and used, as necessary. The stamp-face forming apparatus 1 installs driver software and application software on a personal computer (or a smartphone) and communicates with the personal computer (or a smartphone) through USB connection to cooperate there with. Therefore, the computer programs stored in the stamp-face forming apparatus 1 and the computer software installed in the external device such as the personal computer work together to realize various functions.

For instance, in the case of the stamp-face forming apparatus (printer) which is necessarily connected to PC 44, directly or by wireless, since the user operates on GUI (Graphical User Interface) of PC 44 or a cellular phone, the hardware needs neither the display screen controlling circuit 47 nor the displaying device 43.

UI (user interface) controlling circuit 49 controls a menu screen display in accordance with information which the user enters through the personal computer, using an input device such as a keyboard, a mouse, a remote controller, buttons, and a touch panel, and/or through an input device of the stamp-face forming apparatus (printer). The power source circuit 5 consists of a power source IC (Integrated Circuit) and generates and supplies necessary power to circuits in the printer 1.

The thermal printer 4 receives data and a printing signal output from the central controlling circuit 2 to control operation of the driver IC 4*b* in the thermal head 4, whereby a printing operation is performed on the stamp face material 21 such as the porous ethylene-vinyl acetate copolymer (EVA), which is in contact with the thermal head 4. As described above, the "printing operation" in the present stamp-face forming apparatus (printer) is not a conventional printing operation using ink but means a process of selectively heating the plural heating elements of the thermal head 4 in accordance with image data to determine whether each of dots of a prescribed size composing the surface of the stamp face material 21 is made non-porous or not.

In the present embodiment, other circuits receive only data and signals from the central controlling circuit 2 and obtain from the power source circuit 5 power necessary for printing. By the way, the thermal head 4 of the stamp-face forming apparatus (printer) 1 has an available character width of 48 mm with a resolution of 200 dots/25.4 mm.

The motor driver 8 is a driving circuit for driving the stepping motor 9. Receiving a signal from the central controlling circuit 2, the motor driver 8 supplies the stepping motor 9 with a pulse signal and power. The signal that the motor driver 8 receives is only an excitation signal, but the power to be supplied to the stepping motor 9 is obtained from the power source circuit 5.

The controlling unit (central controlling circuit) 2 counts the number of pulses supplied to the motor driver 8 to determine how much the stepping motor 9 has been made to rotate, in other words, to calculate accurately how much the platen roller has conveyed the stamp-face material holder 20.

In the printer 1 according to the present embodiment, the stepping motor 9 employs 1-2 phase excitation driving and a gear ratio of 16 steps/line (=0.125 mm) is set, whereby one step of the stepping motor 9 conveys the stamp-face material holder 20 by 0.0078 mm.

It is possible for the controlling unit 2 to calculate a conveyance distance by the platen roller 12 not depending on the number of pulses but other method. For instance, the number of rotations of the platen roller 12 is detected by a rotary encoder, and it is possible to use the detected number of rotations of the platen roller 12 to calculate the conveyance distance.

<<Structure of Stamp-Face Material Holder>>

The stamp-face material holder 20 employed by the printer 1 to form a stamp face will be described with reference to FIG. 6A to FIG. 6C, FIG. 7A and FIG. 7B.

Figure 6A:
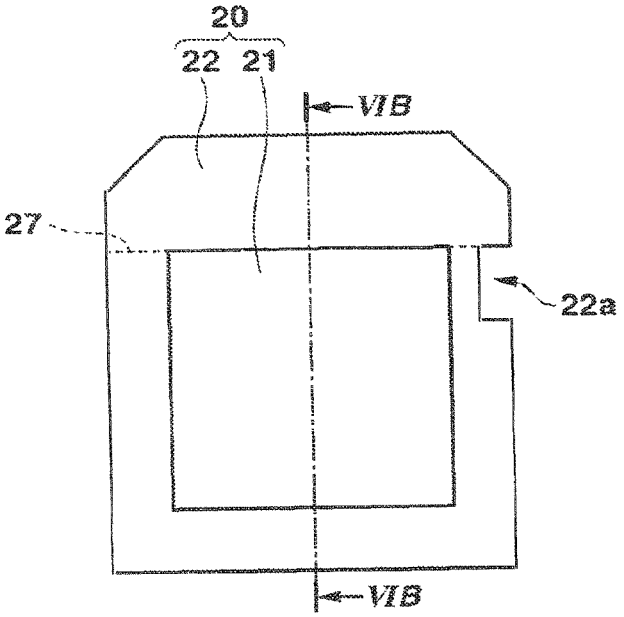
FIG. 6A is a plan view showing one example of the stamp-face material holder holding a holding body used in the stamp-face forming apparatus according to the embodiment of the invention.
Figure 6B:
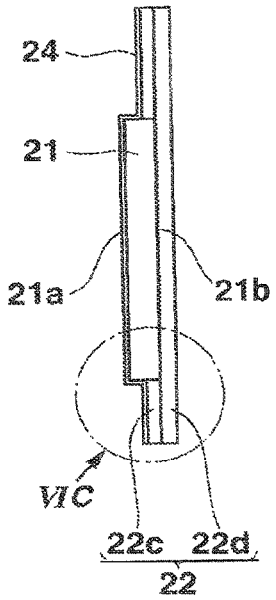
FIG. 6B is a cross section of the stamp-face material holder along the line VIB to VIB of FIG. 6A.
Figure 6C:
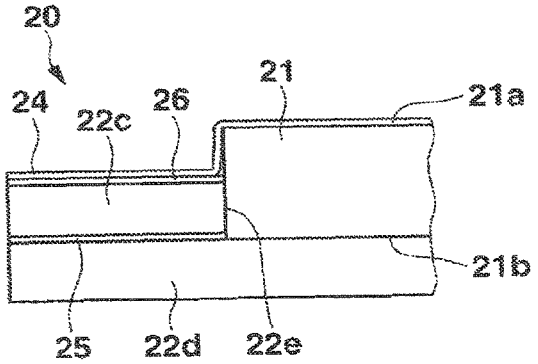
FIG. 6C is a cross section view showing the detail of the portion (structure) indicated by VIC in FIG. 6B.
Figure 7A:
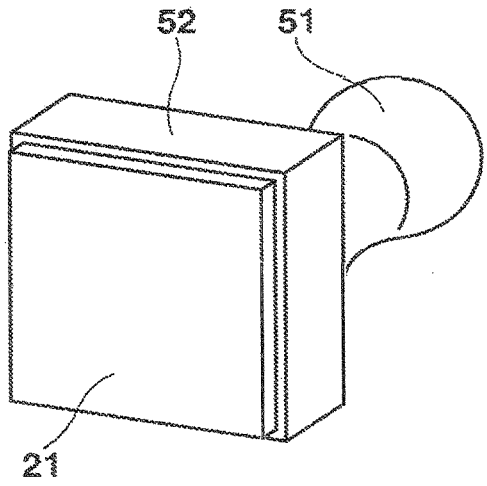
FIG. 7A is a perspective view of a stamp viewed from the stamp face material.
Figure 7B:
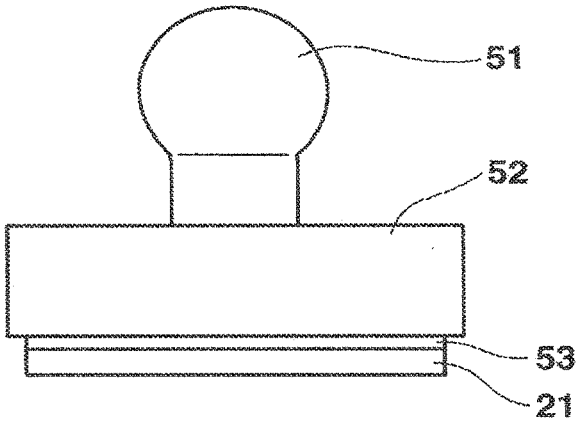
FIG. 7B is a side view of the stamp body placed on the stamp face material.

FIG. 6A to FIG. 6C are views schematically showing one example of the stamp-face material holder 20 used by the printer 1 to form a stamp face. FIG. 6A is a plan view showing a stamp face forming surface of the stamp-face material holder 20. FIG. 6B is a cross section view of the stamp-face material holder 20 along the line VIB to VIB of FIG. 6A. FIG. 6C is a cross section view showing the portion (structure) indicated by VIC in FIG. 6B. FIG. 7A and FIG. 7B are views schematically showing an example of a stamp attached with a stamp face material having a formed stamp face. FIG. 7A is a perspective view of the stamp viewed from the stamp face material. FIG. 7B is a side view of the stamp body placed on the stamp face material.

As described above, the stamp-face material holder 20 comprises the stamp face material 21, the holding body 22 for holding the stamp face material 21, and the film 24 for protecting the stamp face material 21. As shown in FIG. 6A and FIG. 6B, the holding body 22 has the stamp face material 21 fixed approximately at its center.

The stamp face material 21 has a main surface 21*a* formed and used as a stamp face. The stamp face material 21 is made of porous sponge body absorbing liquid ink, such as the porous ethylene-vinyl acetate copolymer (EVA). The stamp face material 21 can be transformed upon receipt of pressure. EVA contains numerous bubbles with ink impregnated.

The holding body 22 and film 24 of the stamp-face material holder 20 are tools used when a stamp face of the stamp face material 21 is formed, and separated from the stamp-face material 21 for re-use or discard, when the stamp face has been formed. The holding body 22 consists of a top cardboard 22*c* and a bottom cardboard 22*d*, both bonded together, wherein the both cardboards are made of coated board, as shown in FIG. 6B and FIG. 6C. Further, as shown in FIG. 6A, the holding body 22 is formed with the notch 22*a* at its one side. For instance, the holding body 22 is coated white to reflect light from the sensor 3 at a high reflection rate.

The top cardboard 22*c* is formed with a positioning recess 22*e* approximately at its center to receive the stamp face material 21 therein, as shown in FIG. 6B and FIG. 6C. The stamp face material 21 is placed in the positioning recess 21*e* to be fixed therein. Meanwhile, the bottom cardboard 22*d* is made in the same external configuration as the top cardboard 22*c* and is formed with no positioning recess, as shown in FIG. 6A and FIG. 6B. With the top cardboard 22*c* bonded together, the bottom cardboard 22*d* contacts with the whole rear surface 21*b* of the stamp-face material 21.

The stamp-face material holder 20 is constructed such that the main surface 21*a* of the stamp face material 21 (the left side surface in FIG. 6B, or the top surface in FIG. 6C) protrudes a little over the upper surface (the left side surface in FIG. 6B, or the top surface in FIG. 6C) of the top cardboard 22*c*. In the present stamp-face material holder 20, for instance, the thickness of the holding body 22 (the total thickness of the top cardboard 22*c* and the bottom cardboard 22*d* bonded together) is set to 1.2 mm, and the total thickness of the stamp-face material holder 20 including the film 24 and the stamp face material 21 is set to 1.8 mm. That is, the stamp face material 21 is set to protrude over the top cardboard 22*c* by 0.6 mm.

As shown in FIG. 6B and FIG. 6C, the stamp-face material holder 20 has the film 24 coating the holding body 22 and the stamp face material 21. The film 24 is made of the base material such as PET and/or polyimides, and is enhanced in heat resistance, thermal conductivity and surface smoothness. Concerning the heat resistance of the film 24, the film 24 is used, which can enough withstand a temperature of the thermal head 4 for forming a stamp face and a temperature higher than the melting point of the stamp face material 21. Concerning the thermal conductivity of the film 24, the film is used, which conducts the stamp-face forming heat of the thermal head 4 to the stamp face material 21 to melt the same well. Concerning the surface smoothness of the film 24, the film 24 is used, which can pass though the pressing portion 4*a* of the thermal head 4 with less friction when a stamp face is formed.

As shown in FIG. 6C, for instance, the top cardboard 22*c* and the bottom cardboard 22*d* are bonded together by a double-sided adhesive sheet 25. The film 24 is bonded onto the portion of the holding body 22 surrounding the stamp face material 21 fixed thereon, that is, the film 24 is bonded to the upper surface of the top cardboard 22*c* by a double-sided adhesive sheet 26. The film 24 just contacts with the stamp face material 21 and the bottom cardboard 22*d* but are not bonded to them.

Although an example of the stamp-face material holder 20 to be subjected to the stamp-face forming process performed by the printer 1 according to the embodiment of the invention has been described with reference to FIG. 6A to FIG. 6C, plural sorts of stamp-face material holders 20 with the stamp face materials 21 (shown in FIG. 6A) of different sizes can be subjected to the stamp-face forming process. When the stamp face materials 21 of different sizes are processed, the thickness and the width (size in the cross direction in FIG. 6A) of each of the various sorts of stamp-face material holders 20 are set to the same, and the lengths (size in the longitudinal direction in FIG. 6A) of the stamp-face material holders 20 are set differently depending on the sizes of the stamp face materials 21. The holding body 22 is provided with notch 22*a* whose size (for instance, size in the longitudinal direction in FIG. 6A) is determined on the basis of the size of the stamp face material 21 to be held in the stamp-face material holder 20. The sensor 3 of the printer 1 detects the notch 22*a* to determine the size of the notch 22*a*, thereby specifying the sort (size) of the stamp face material 21 held in the stamp-face material holder 20.

Once a stamp face has been formed by the printer 1, the stamp face material 21 is removed from the holding body 22. The stamp-face forming apparatus (printer) 1 of the present invention makes a feature of easy removal of the stamp face material 21 from the holding body 22, in other words, a feature of heating controlling or a heating range, which will be described later. The removed stamp face material 21 will be bonded to a stamp consisting of a ball-like handle 51 and a block 52. More precisely, the stamp face material 21 is bonded to the bottom surface of the block 52 of the stamp with a double-sided adhesive sheet 53, as shown in FIG. 7A and FIG. 7B.

<<Principle of Stamp Face Forming>>

The principle of forming a stamp face on the stamp face material 21 will be described.

As described above, the stamp face material 21 is made of the ethylene-vinyl acetate copolymer (EVA). Since EVA has a physical property of thermo-plasticity, portions of EVA will be soften and stiffened, when the portions are heated once to temperatures 70 to 120 degrees centigrade and cooled down. The stiffened portion of EVA will become non-porous, preventing liquid ink from exuding therefrom.

The printer 1 according to the embodiment of the invention uses this special quality of the stamp face material (EVA) 21, and heats the surface of EVA at its arbitrary portions for about 1 to 5 msec. thereby making the portions non-porous, preventing the liquid ink from exuding therefrom. The stamp face material 21 has been previously cut into a square by a heat cutter. When the stamp face material 21 is cut by the heat cutter, all the four sides of the stamp face material 21 are heated and made non-porous. Therefore, the liquid ink cannot exude out from the side surfaces of the stamp face material 21. The rear surface 21*b* of the stamp face material 21 has been subjected to a heating process, preventing the liquid ink from exuding therefrom. As a result, the liquid ink is prevented from exuding from the stamp face material 21, excepting from the main surface 21*a*.

When a stamp face is formed on the stamp face material 21, the portions of the stamp face material 21 which allow the liquid ink to exude therefrom are not heated, and the portions of the stamp face material 21 which prevent the liquid ink from exuding therefrom are heated, whereby the portion which allows the liquid ink to exude therefrom can be formed in accordance with a stamp impression which the user wants to obtain when he/she puts his/her stamp. It is considered that errors occur while the stamp face is formed, and the liquid ink does not pass through the side surfaces of the stamp face material 21, and therefore the size of the stamp face material 21 is set to be a little larger than the size of the stamp impression. For instance, in the case of the stamp impression of 45 mm×45 mm, the size of the stamp face material 21 is set to 48 mm×48 mm.

<<Stamp-Face Forming Operation>>

The operation of forming a stamp face performed in the printer 1 according to the embodiment of the invention will be described. The following functions are stored in the memory controlling unit 48 (more specifically, in ROM) as in a form of a computer readable program code. The operations are successively performed in accordance with the program code. As described above, in general the printer 1 cooperates with a computer and/or a smartphone, but only the operations performed in the printer 1 will be described for simplicity.

Figure 8A:
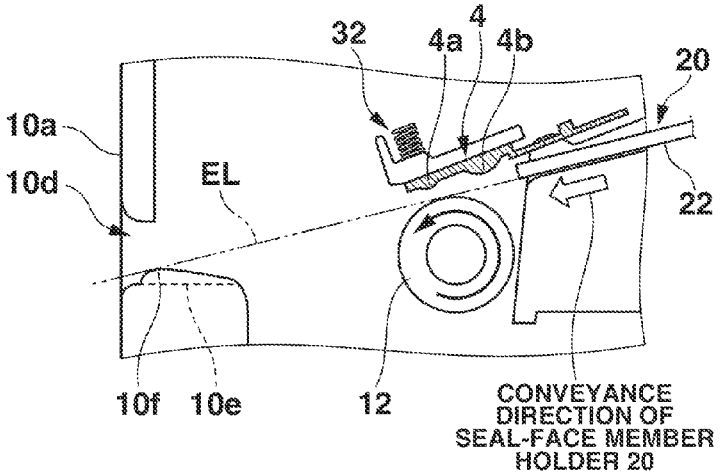
FIG. 8A to FIG. 8C are views showing the operation of forming a stamp face performed in the printer 1 according to the embodiment of the invention.
Figure 8B:
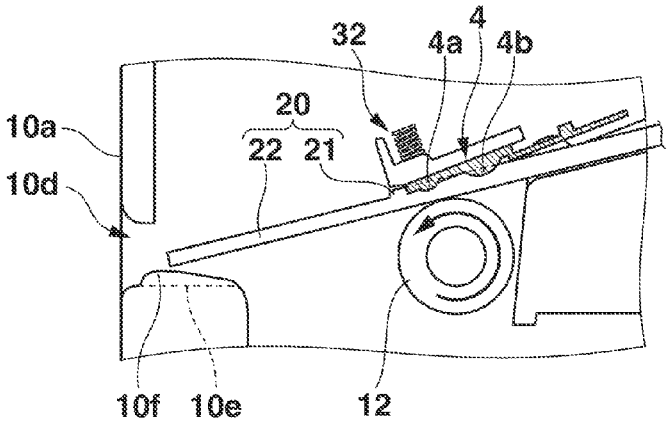
Figure 8C:
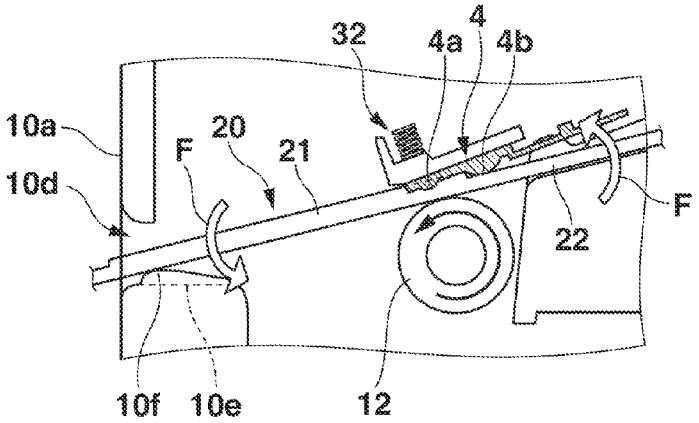

FIG. 8A to FIG. 8C are views showing the operation of forming a stamp face performed by the printer 1 according to the embodiment of the invention.

At first, the input operation unit 6 is operated to generate a signal of starting operation of the printer 1. Upon receipt of the signal, the controlling unit 2 starts the initial operation and sends a driving signal to the motor driver 8 to rotate the stepping motor for a prescribed time, whereby the platen roller 12 rotates for the prescribed time to eject the stamp-face material holder 20 from the outlet 10*d*, even if the stamp-face material holder 20 stays within the printer 1.

After the initial operation, when an operator of the printer 1 operates the input operation unit 6 to generate a starting signal of forming a stamp face, with the stamp-face material holder 20 inserted into the printer 1 through the insertion opening 10*c* as shown in FIG. 8A, the controlling unit 2 rotates the stepping motor 9 to rotate the platen roller 12, whereby the stamp-face material holder 20 is conveyed along the guide 14 (inclines plane 14*a*) in the +X-direction.

In the case where plural sorts (sizes) of stamp-face material holders 20 are used in the stamp-face forming process, the controlling unit 2 detects the length of the notch 22*a* of the stamp-face material holder 20 (holding body 22) with the sensor 3 to specify the sort (size) of the stamp-face material holder 20 (size of the stamp face material 21). The controlling unit 2 controls the mechanism 32 based on the detected sort (size) of the stamp-face material holder 20 to adjust the distance H between the thermal head 4 and the platen roller 12 in accordance with the sort (size) of the stamp-face material holder 20. In this way, the pressing force by the thermal head 4 against the stamp face material 21 can be set properly.

When the stamp-face material holder 20 has been conveyed further in the +X-direction, as shown in FIG. 8B, the pressing portion 4*a* of the thermal head 4 passes through over the holding body 22 and reaches to the stamp face material 21. The stamp face material 21 of the stamp-face material holders 20 is brought beneath the thermal head 4 and further conveyed under the prescribed pressure, receiving heat from the plural heating elements disposed on the pressing portion of the thermal head 4 in the Y-direction, whereby a stamp face is formed on the stamp face material 21.

More specifically, the controlling unit 2 controls based on entered image data combination of conveyance (rotation of the stepping motor 9) of the stamp-face material holder 20 and selection of the heating elements of the thermal head 4 to be heated, and selectively heats portions of the stamp face material 21 corresponding to the image data, thereby forming portions allowing ink to exude therefrom and portions preventing ink from exuding therefrom to form a stamp face.

As described above, since EVA used for the stamp face material 21 is a porous sponge body and very soft, it is necessary to press the heating elements of the thermal head 4 against the stamp face material 21 on the stamp-face material holder 20 more strongly than a thermal printing performed in average printers. For that purpose, the stamp-face material holder 20 is constructed such that the main surface 21*a* of the stamp face material 21 protrudes over the holding body 22, as shown in FIG. 6B and FIG. 6C. In the state where the thermal head 4 is pressed against the stamp face material 21 of the stamp-face material holder 20 as shown in FIG. 8B, the pressing portion 4*a* where the plural heating elements of the thermal head 4 are disposed and the driver IC 4*b* provided in the vicinity of the heating elements are pressed against the stamp face material 21 intrude in the stamp face material 21.

When the stamp-face material holder 20 is further conveyed in the +X-direction while a stamp face is formed on the stamp face material 21, the thermal head 4 reaches the end of the stamp face material 21 in the −X-direction and passes through the boundary between the stamp face material 21 and the holding body 22. At this time, the end of the holding body 22 in the +X-direction reaches the outlet 10*d* and the bottom surface of the holding body 22 in the vicinity of the end contacts with the plural ribs 10*f* provided inside (10*e*) the outlet 10*d*, whereby the plural ribs 10*f* support the stamp-face material holder 20.

As described above, since the stamp-face material holder 20 is constructed such that the stamp face material 21 protrudes over the holding body 22 (refer to FIG. 6B, FIG. 6C), there is a difference in level at the boundary between the stamp face material 21 and the holding body 22. In the vicinity of the pressing portion 4*a* of the thermal head 4 (in the −X-direction), there is arranged the driver IC 4*b*. Further, since the thermal head 4 is strongly pressed against the stamp face material 21, the driver IC 4*b* of the thermal head 4 will slide down along the difference when the thermal head 4 passes through the boundary between the stamp face material 21 and the holding body 22. At this time, the stamp-face material holder 20 is momentarily released from the pressing force by the driver IC 4*b* and receives rotation force to urge to bend its end portion in the +X-direction downward and to urge to bend its other end portion in the −X-direction upward, as indicated by arrows F, F in FIG. 8C.

In a structure where the outlet 10*d* has no ribs 10*f* and the end portion of the stamp-face material holder 20 in the +X-direction is not supported by the ribs 10*f*, the stamp-face material holder 20 receives the rotation force and rotates as indicated by the arrows F, F at the moment when the driver IC 4*b* of the thermal head 4 has slidden down the difference in level between the stamp face material 21 and the holding body 22. As a result, a sending distance of the stamp-face material holder 20 by the platen roller 12 will change, whereby irregularity in printing will be caused on the main surface 21*a* of the stamp face material 21 due to the change in the sending distance of the stamp-face material holder 20. Accordingly, it can form an impertinent stamp face.

Meanwhile, in the printer 1 according to the present embodiment shown in FIGS. 2A, 2B, 4A and 4B, there are disposed the plural ribs 10*f* inside (10*e*) the outlet 10*d* such that the tops of the ribs 10*f* will contact with the extending line EL of the inclined plane 14*a*, on which the stamp-face material holder 20 is conveyed during the operation of forming a stamp face. Within the printer 1 having the structure described above, the stamp-face material holder 20 is supported along the conveyance path by the inclined plane 14*a*, the platen roller 12, and the plural ribs 10*f* provided on the outlet 10*d*. Therefore, the stamp-face material holder 20 is suppressed from rotating under the rotation force applied thereto at the moment when the driver IC 4*b* of the thermal head 4 has slidden down the difference in level between the stamp face material 21 and the holding body 22, whereby an appropriate stamp face is formed.

When the stamp-face material holder 20 is further conveyed in the +X-direction, and a stamp face has been formed thereon, the stamp-face material holder 20 will be ejected from the outlet 10*d* of the printer 1. Then, the controlling unit 2 ceases rotation of the stepping motor 9, stopping the platen roller 12 to finish the series of stamp-face forming operations. For example, the timing of stopping the stepping motor 9 by the controlling unit 2 is set to a time when a prescribed time lapses after the tail end of the stamp-face material holder 20 has passed through the sensor 3

<<Roles of Holding Body and Film>>

EVA used as the stamp face material is a material of a 1.5 mm width and has a high elastic modulus and a high friction coefficient. Therefore, it is hard to insert EVA into the printer 1 to make EVA pass through the thermal head 4 stably and straightly, because of large friction between the thermal head 4 and EVA. Since EVA has a large friction coefficient and is soft like gum, even if the thermal printer is provided with guides for guiding the stamp face material made of EVA to advance stably and straightly, EVA can easily bend and advance aslant sideway.

The above inconvenience caused on EVA in the conveyance path is a phenomenon caused even if the thermal head is not heated, but when the thermal head is heated, the head will increase its temperature to approximately 200 degrees within several milliseconds after the thermal head starts heating. Therefore, a phenomenon can be caused that the surface of EVA will be softened at the moment the surface of EVA is heated and the thermal head will intrude into the softened portions of EVA, preventing EVA from being conveyed.

In a method of using an edge head and a method of using a carriage for moving a head, the above inconvenience is not caused, but a mechanism for performing these methods will increase in size and costs of parts used in the mechanism will greatly increase.

In the printer 1 according to the present embodiment of the invention, increasing neither mechanism in size nor manufacturing cost, an average thermal head is employed to form a stamp face, using EVA having vices for conveyance as the stamp face material, wherein the stamp-face material holder 20 and the holding body 22 are coated and protected with the film 24.

Since the stamp face material 21 is fixed in the positioning recess 22*e* of the top cardboard 22*c* and supported from beneath by the bottom cardboard 22*d*, and further coated with the film 24, the stamp face material 21 keeps the state held in the stamp-face material holder 20, and does not change its shape even if it receives external forces in the X- and Y-directions.

The stamp-face material holder 20 is conveyed, and the stamp face material 21 is also conveyed just as the stamp-face material holder 20 is conveyed. When the stamp-face material holder 20 is conveyed straight, and then the stamp face material 21 is also conveyed straight. The film has a heat-resisting property which is higher than the melting point of the stamp face material (EVA) 21. Therefore, even if the thermal head 4 melts the surface of the stamp face material (EVA) 21, the film 24 does not melt. In other words, the film 24 does not lose the function of coating the stamp face material 21 and keeps extremely low friction with the thermal head 4.

Therefore, even if the stamp face material 21 is heated and melts, the film 24 prevents thermal head 4 from being caught by the stamp face material 21, allowing the thermal head 4 to continue the thermal printing operation along the surface of the film 24. In this way, a stamp face is formed steadily on the stamp face material 21.

<<Removal of Stamp Face Material>>

The top cardboard 22*c* and the bottom cardboard 22*d* composing the holding body 22 are prepared with a perforation 27 along the top side of the positioning recess 22*e*, as shown in FIGS. 6A, 6B, 9A, 9B and 9C. The perforation extends to the both sides of the top and bottom cardboards 22*c*, 22*d*.

The film 24 coats the side and the top surface of the stamp face material 21 exposed from the positioning recess 22*e* but is not bonded to them. Therefore, when the both cardboards 22*c* and 22*d* are bent to the rear side along the perforation 27 after a stamp face is formed on the stamp face material 21, the stamp face material 21 can easily be removed from the stamp-face material holder 20.

Figure 9A:
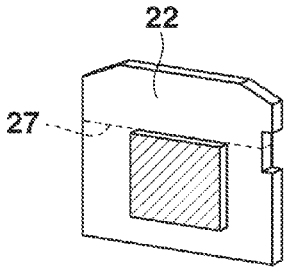
FIG. 9A is a perspective view of the holding body with a perforation prepared thereon.
Figure 9B:
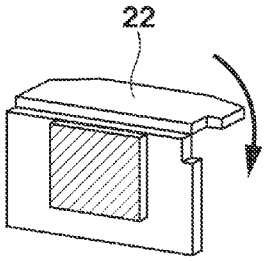
FIG. 9B is a perspective view of the holding body bent to the rear side along the perforation.
Figure 9C:
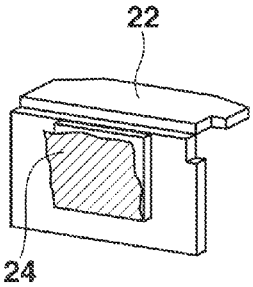
FIG. 9C a perspective view of the holding body with the film tore off, allowing a user to take out the stamp face material.

FIG. 9A, FIG. 9B, and FIG. 9C are views showing a procedure of removing the stamp face material 21 from the stamp-face material holder 20, after a stamp face has been formed on the stamp face material 21. FIG. 9A is a perspective view of the holding body 22 with the perforation 27 prepared thereon. FIG. 9B is a perspective view of the holding body 22 bent to the rear side along the perforation 27. FIG. 9C a perspective view of the holding body 22 with the film 24 tore off for allowing the user to take out the stamp face material 21.

<<Configuration of Holding Body for Allowing Film to be Easily Torn>>

From the holding body 22 with the film 24 tore off, as shown in FIG. 9C, the inventor of the invention has become aware of a fact that the stamp face material 21 will easily be removed from the holding body 22, if the film 24 is easily tore off along the configuration of the stamp face material 21. The inventor thinks, if the film 24 is heated by the thermal head 4, durability of the film 24 will be deteriorated and the film 24 will be made easy to be torn. The inventor has found a method of controlling the heat to be applied to the portions of the film 24 which are in contact with the edges of the stamp face material 21 while a stamp face is formed.

Figure 10:
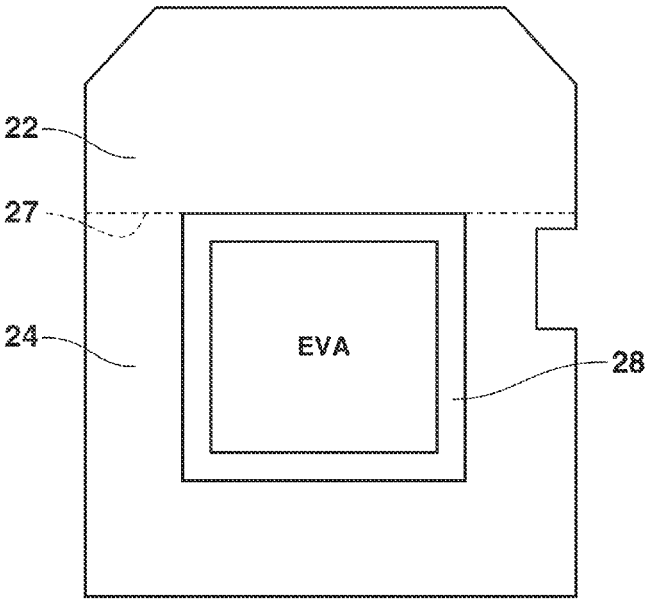
FIG. 10 is a plane view showing the stamp-face material holder indicating portions where the increasing heat is applied.

FIG. 10 is a plane view showing the stamp-face material holder 20 indicating portions 28 where the increasing heat is applied. The method is to increase the heat to be applied to the edge portions 28 of the stamp face material (EVA) 21, making PET film 24 corresponding to the edge portions 28 contract extremely, thereby deteriorating the film 24 and making the film 24 easy to be torn. Increasing the heat can be controlled based on a heating duration in which heat is applied and also can be controlled by a voltage to be applied to the thermal head 4. Increasing the heat can be controlled based on both the heating duration and the voltage to be applied to the thermal head.

As described above, the stamp-face material holder (EVA) 20 is produced larger in size than a size indicated by data to be printed by about 1 to 2 mm respectively in all directions. Even if the printer has mechanical variations and/or there are variations in position where the EVA is held by the holding body 22, the data of stamp face desired by the user is prevented from protruding from the EVA. The extra portions are "heated regions" which prevent ink from exuding therefrom. Since the heated regions occupy the portion other than the data the user desires, and even if the heated regions are heated excessively, the heated regions give no bad effect to the completed stamp face. Heating the extra portions excessively, and increasing heat is applied to the edges of EVA, whereby PET film will be deteriorated. The heated regions 28 of the stamp face material 21 are shown in FIG. 10.

In the above description, all the four sides of the heated regions (EVA) 28 are heated a lot, but it will be possible to heat only the top side of EVA or three sides out of the four sides other than bottom side. Preferably, it is better to heat a lot only the three sides of EVA other than bottom side.

The first reason for that is in that the holding body 22 (top cardboard 22*c*, bottom cardboard 22*d*) of the stamp-face material holder 20 has the perforation 27 prepared along the extending line of the top side of EVA. When the holding body 22 (cardboards 22*c* and 22*d*) is bent along the perforation 27, EVA will easily be removed from the holding body 22. Therefore, it is also preferable the film 24 is deteriorated at the portion corresponding to the perforation 27. With this structure, when the holding body 22 (cardboards 22*c* and 22*d*) is bent along the perforation 27, PET film 24 will be torn at the portion corresponding to the top side of EVA.

The second reason for that is in that if the three sides of film 24 are deteriorated, the three sides can easily be torn, allowing the user to easily pick out EVA from the holding body 22 with his/her fingers. Therefore, it is preferable to heat the left and right sides of film 24 to make both sides easy to be torn.

But if the thermal head 4 should have heated EVA too much to deteriorate excessively, EVA with PET film stuck together can be removed from the holding body 22.

By decreasing the heat to be applied to the bottom side of PET film 24, PET film 24 is prevented from being separated from the holding body 22 (cardboards 22*c* and 22*d*) when EVA is removed from the holding body 22. In the above arrangement, by increasing the heat to be applied to EVA in the stamp-face material holder 20, PET film 24 is deteriorated and made easy to be torn.

<<Specific Method of Increasing Heat>>

As described above, the thermal head 4 is used to perform the thermal printing operation in accordance with data (stamp impression data) of a stamp impression to form a stamp face on the stamp face material 21. During the thermal printing operation, a combining process is performed to combine the stamp impression data with data of increasing the heat to be applied to the edge portions of the stamp face material 21, as shown in FIG. 10.

It is possible for the controlling unit 2 to perform the combining process under its control and is also possible for the personal computer (smartphone) to run driver software and/or application software to perform the combining process.

<<Combining Process of Image Data>>

FIG. 11A, FIG. 11B, FIG. 11C, FIG. 11D, and FIG. 11E are views illustrating images each drawn by combining a stamp face image and edge portions to be heated by increased heat during the stamp-face forming operation. The heat increasing operation and the stamp-face forming operation are simultaneously performed in the printer 1 according to the present embodiment of the invention. In the combining process, two sorts of data are used, that is, one is data (hereinafter, referred to as the "stamp-face image data") representing the user's desired stamp face, and the other is data ("additionally-heating data") indicating the edge portions 28 of the stamp face material 21 to which increased heat is applied. The combining process of combining the stamp-face image data with the additionally-heating data is performed either by the controlling unit 2 of the stamp-face forming apparatus 1 or by the controlling unit of the personal computer (smartphone) 44, whereby thermal heating data is obtained. Based on the thermal heating data, the controlling unit 2 of the stamp-face forming apparatus 1 generates and sends a signal for controlling the heating elements to the thermal head 4 through the driver IC 4*b*.

Figure 11A:
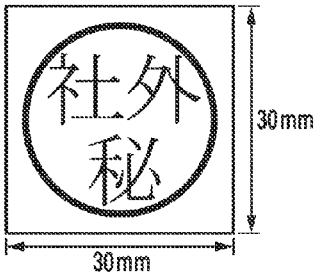
FIG. 11A is a view illustrating original image data produced or selected by a user, representing a stamp impression which the user wants to obtain.

FIG. 11A is a view illustrating original image data produced or selected by the user, which represents an image of a stamp impression that the user wants to obtain when he/she affixes a stamp. As shown in FIG. 11A, the user is allowed to produce (select) an image of a stamp impression within a range of 30 mm×30 mm. The user can produce (select) the image of a stamp impression, using a function of application software installed on the personal computer (smartphone) 44 (refer to FIG. 5) connected to the stamp-face forming apparatus 1.

Figure 11B:
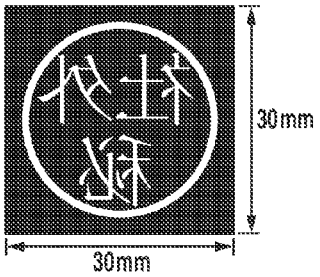
FIG. 11B is a view showing image data subjected to black/white reversal and right/left inversion for forming a stamp face.
Figure 11C:
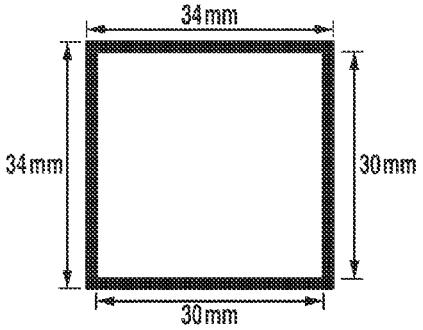
FIG. 11C is a view showing the edge portions of the stamp face material where increased heat is applied.

To obtain an image of a stamp face, it is necessary to subject the image of FIG. 11A to a black/white reversal and to a right/left inversion. FIG. 11B is a view showing image data subjected to the black/white reversal and the right/left inversion for forming a stamp face. In the stamp-face forming apparatus 1 according to the embodiment of the invention, a process is performed to combine the image data (stamp-face image data) shown in FIG. 11B with data (additionally-heating data) for applying the edge portions of the stamp face material with increased heat. FIG. 11C is a view showing the edge portions 28 of the stamp face material 21 where increased heat is applied, that is, showing the additionally-heating data. As shown in FIG. 11C, the edge portions 28 of the stamp face material 21 where increased heat is applied is a portion surrounding a square of 30 mm×30 mm having a width of 2 mm, and having an outer square circumference of 34 mm×34 mm.

Figure 11D:
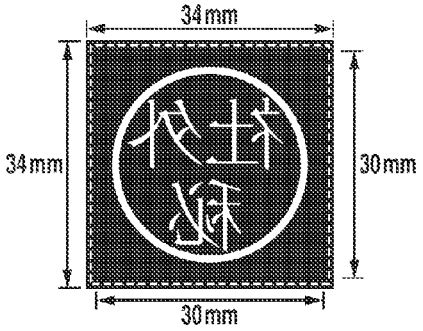
FIG. 11D is a view showing superimposed image data which is obtained by superimposing the image data of FIG. 11B onto the image shown in FIG. 11C.

FIG. 11D is a view showing data (thermal printing data) which is obtained by combining the stamp-face image data shown in FIG. 11B with the additionally-heating data shown in FIG. 11C. Based on the thermal printing data shown in FIG. 11D, the controlling unit 2 heats the thermal head 4 to form a stamp face on the stamp face material 21. As a result, the sear-face forming operation and the operation of heating the edge portions 28 are simultaneously performed in the printer 1. In the thermal printing data shown in FIG. 11D, a position of the stamp face material 21 is indicated by a broken line, and the size of the stamp face material 21 is 32 mm×32 mm.

Figure 11E:
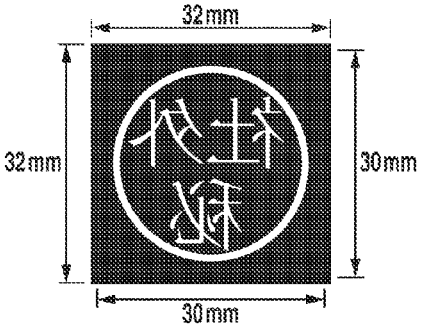
FIG. 11E is a view showing the stamp face material with a stamp face formed thereon.

FIG. 11E is a view showing the stamp face material 21 with a stamp face formed thereon. The stamp face material 21 shown in FIG. 11E has a size of 32 mm×32 mm. To prepare in the stamp face material 21 the edge portions 28 where the increased heat is to be applied means that an extra portion having a width of 1 mm and surrounding the stamp face material 21 is also heated, whereby the film 24 contacting to such edge portions 28 will also be heated and deteriorated, allowing the user to take out the stamp face material 21 easily from the holding body 22.

<<Use of Stamp Face Material with a Stamp Face>>

In the stamp-face forming apparatus 1 according to the embodiment of the invention, the stamp-face image data and the additionally-heating data are combined together to generate the thermal printing data, and the thermal head 4 uses the thermal printing data to heat EVA surface, thereby forming a stamp face having the user's desired stamp impression, and also making the film 24 easy to be torn along the configuration of the stamp face material 21. To take the stamp face material 21 out from the holding body 22 after a stamp face has been formed on the stamp face material 21, the user is simply required to bend the holding body 22 along the perforation 27 to pull the stamp face material 21 out from the holding body 22. Thereafter, the stamp face material 21 with a stamp face formed thereon is bonded onto the block 52 and soaked in ink for a prescribed time. If ink is of high viscosity, the surface of the stamp face material 21 is smeared with the ink and left for a while. After a prescribed time lapsed, the ink will have impregnated into the stamp face material 21. The user wipes off excess ink on the surface of the stamp face material 21, and affixes the block 52 having the stamp face on paper, whereby the ink exudes, leaving a stamp impression on the paper.

<<Use of Stamp-Face Forming Apparatus>>

When the stamp-face forming apparatus 1 according to the embodiment of the invention is used independently from other electronic apparatus, it is necessary to enter image data for forming a stamp face. In addition to the configuration shown in the block diagram of FIG. 5, it will be necessary to provide a reader for reading image data from SD card and/or USB memory and to form a stamp face based on the image data. When the image data is not the thermal printing data, the controlling unit 2 of the stamp-face forming apparatus 1 will be required to perform the combining process, thereby combining stamp-face image data with additionally-heating data.

<<Stamp-Face Forming System>>

The personal computer 44 is indicated in the block diagram of FIG. 5. In place of the personal computer 44, a smartphone and/or a tablet type computer can be used. It is possible to connect the smartphone and/or the tablet type computer with the present printer 1 through a cable or wireless communication.

In the case of the personal computer, the personal computer with application software and/or driver software installed therein is connected with the stamp-face forming apparatus 1 through a wire and/or wireless communication. Then the stamp-face forming apparatus 1 connected with such personal computer in the above manner can be used as an average printer. This state will be referred to as the "stamp-face forming system", in which the stamp-face forming apparatus 1 is connected with the personal computer in the above manner and cooperates with the computer.

<<Process Performed by Controlling Unit of Stamp-Face Forming Apparatus>>

In the stamp-face forming system, the user uses the application software to make image data to form a stamp face. When a size of the stamp face material 21 is selected by the user, the application software and the driver software cooperate to superimpose appropriate additionally-heating data on the stamp-face image data to produce thermal printing data for producing a stamp impression, and send the thermal printing data to the stamp-face forming apparatus 1. In this way, the load to be processed by the controlling unit 2 of the stamp-face forming apparatus 1 will be reduced and also a waiting time before forming a stamp face can be decreased.

In the stamp-face forming apparatus 1, the combining process of superimposing the additionally-heating data on the stamp-face image data should be performed by the controlling unit 2 to produce thermal printing data for producing a stamp impression. But when the stamp-face forming apparatus 1 is connected with an external apparatus such as the personal computer, it is possible to leave such combining process of superimposing the additionally-heating data on the stamp-face image data for such external apparatus in place of the controlling unit 2.

<<User Interface by Personal Computer>>

As shown in FIG. 5, the stamp-face forming apparatus 1 connected with the personal computer (smartphone) 44 through a wire and/or wireless communication. The stamp-face forming apparatus 1 can share the function of the user interface with the personal computer (smartphone) 44.

As shown in FIG. 4A and FIG. 6A, the holding body 22 of the stamp-face material holder 20 is provided with the notch 22*a*. When the stamp-face material holder 20 passes through over the sensor 3 mounted on the stamp-face forming apparatus 1, as shown in FIG. 4A, the sensor 3 detects an object on the scanning line (broken line) SL. Since the notch 22*a* is provided on the scanning line (broken line) SL, the sensor 3 can detect the shape of the notch 22*a*. The notch 22*a* has information of a size of the stamp face material 21 held on the stamp-face material holder 20.

Since the notch 22*a* is provided on the holding body 22 at an upstream position than the position where the stamp face material 21 is held in the conveyance path, the sensor 3 detects the size of the stamp face material 21 first when the stamp-face material holder 20 is conveyed, and sends information of the detected size of the stamp face material 21 to the controlling unit 2.

The controlling unit 2 compares the size of the stamp face material 21 detected by the sensor 3 with a size indicated by the thermal printing data (combined data of the additionally-heating data and the stamp-face image data), and ceases the stamp-face forming operation when both sizes are different. Further, the controlling unit 2 gives notice of ceasing the stamp-face forming operation to the personal computer (smartphone) 44 through Bluetooth (registered trademark) module • wireless LAM module 41 and/or USB controlling circuit 40.

Upon receipt of the notice, the personal computer (smartphone) 44 displays an error message telling the user to that effect. It is preferable to indicate appropriate information of an stamp-face material holder and also to display message to the user, asking him/her to change the stamp-face material holder to an appropriate one and to remake the thermal printing data for producing a stamp impression.

Error message processing means and error message displaying means are provided on the personal computer (smartphone) 44. CPU of the personal computer (smartphone) 44 reads the application software and the driver software to realize these means and displays the message on its display unit. In this way, the personal computer (smartphone) 44 serves as the user interface of the stamp-face forming apparatus 1 according to the embodiment of the invention.

Although the specific configurations of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. A stamp-face forming apparatus for forming a stamp face, comprising:

a stamp-face forming unit which is provided with plural heating elements disposed so as to face a surface of a stamp face material, and which forms the stamp face on the stamp face material, wherein the stamp face material includes porous material which is adapted to become non-porous when heated, and the stamp face material is detachably held in a holding body and is at least partially coated with a film; and a controlling unit which controls the stamp-face forming unit such that an amount of heat per unit area to be applied to a part of the film facing at least one of edge portions of the stamp face material is larger than an amount of heat per unit area applied to a part of the film facing a portion of the stamp face to be non-porous.

2. The stamp-face forming apparatus according to claim 1, wherein:

a conveyed object includes the stamp face material, the holding body and the film, and the part of the film facing at least one of the edge portions of the stamp face material corresponds to a frontward portion of the conveyed object when seen in a conveyed direction in which the conveyed object is conveyed.

3. The stamp-face forming apparatus according to claim 2, wherein the part of the film facing at least one of the edge portions of the stamp face material corresponds to front, right and left portions of the conveyed object when seen in the conveyed direction in which the conveyed object is conveyed.

4. The stamp-face forming apparatus according to claim 1, wherein the controlling unit controls the amount of heat depending on a time duration in which the amount of heat is applied.

5. The stamp-face forming apparatus according to claim 1, wherein the controlling unit controls the amount of heat depending on a voltage at which the amount of heat is applied.

6. The stamp-face forming apparatus according to claim 1, wherein the controlling unit controls the amount of heat depending on both a time duration and a voltage, at which the amount of heat is applied.

7. A method of forming a stamp face on a stamp face material, in a stamp-face forming apparatus which is provided with a stamp-face forming unit, the stamp-face forming unit having plural heating elements for heating the stamp face material to form the stamp face thereon, wherein the stamp face material includes porous material which is adapted to become non-porous when heated, and the stamp face material is detachably held in a holding body and is at least partially coated with a film, and wherein a conveyed object includes the stamp face material, the holding body and the film, the method comprising:

conveying the conveyed object to pass through the stamp-face forming unit such that the surface of the stamp face material is in contact with the plural heating elements of the stamp-face forming unit, thereby forming the stamp face on the stamp face material; and controlling an amount of heat to be applied from the heating elements to the film while the heating elements form the stamp face on the stamp face material, such that an amount of heat per unit area to be applied to a part of the film facing at least one of edge portions of the stamp face material is larger than an amount of heat per unit area applied to a part of the film facing a portion of the stamp face to be non-porous.

8. The method of forming the stamp face on the stamp face material according to claim 7, wherein the part of the film facing at least one of the edge portions of the stamp face material corresponds to a frontward portion of the conveyed object when seen in a conveyed direction in which the conveyed object is conveyed.

9. The method of forming the stamp face on the stamp face material according to claim 7, wherein the part of the film facing at least one of the edge portions of the stamp face material corresponds to front, right and left portions of the conveyed object when seen in a conveyed direction in which the conveyed object is conveyed.

10. The method of forming the stamp face on the stamp face material according to claim 7, wherein the amount of heat is controlled depending on a time duration in which the amount of heat is applied.

11. The method of forming the stamp face on the stamp face material according to claim 7, wherein the amount of heat is controlled depending on a voltage at which the amount of heat is applied.

12. The method of forming the stamp face on the stamp face material according to claim 7, wherein the amount of heat is controlled depending on both a time duration and a voltage, at which the amount of heat is applied.

13. A stamp-face forming system comprising:

a stamp-face forming apparatus; and a computer apparatus, (i) wherein the stamp-face forming apparatus is for forming a stamp face on a stamp face material and comprises:

a stamp-face forming unit which is provided with plural heating elements disposed so as to face a surface of the stamp face material, and which forms the stamp face on the stamp face material, wherein the stamp face material includes porous material which is adapted to become non-porous when heated, and the stamp face material is detachably held in a holding body and is at least partially coated with a film, and a conveyed object includes the stamp face material, the holding body and the film;

a communication unit which communicates with the computer apparatus; and a controlling unit which controls the stamp-face forming unit based on data received by the communication unit, such that an amount of heat per unit area to be applied to a part of the film facing at least one of edge portions of the stamp face material is larger than an amount of heat per unit area applied to a part of the film facing a portion of the stamp face to be non-porous, and (ii) wherein the computer apparatus comprises:

an image data producing unit which selects the stamp face material and produces or selects image data for forming the stamp face on the selected stamp face material by heating;

an additionally-heating data producing unit which produces additionally-heating data used for heating the stamp face material such that the amount of heat per unit area to be applied to a portion close to the one of the edge portions of the stamp face material is larger than the amount of heat per unit area applied to other portion of the stamp face material, and superimposes the additionally-heating data on the image data for forming the stamp face, thereby superimposing the produced additionally-heating data on the image data produced by the image data producing unit; and an outputting unit which outputs the superimposed image-data to the communication unit of the stamp-face forming apparatus.

14. The stamp-face forming system according to claim 13, wherein:

the part of the film facing at least one of the edge portions of the stamp face material in which the amount of heat per unit area to be applied to is controlled by the controlling unit of the stamp-face forming apparatus corresponds to a front portion of the conveyed object when seen in a conveyed direction in which the conveyed object is conveyed, and the portion close to the edge portions of the stamp face material with respect to which the additionally-heating data is produced and superimposed on the image data by the additionally-heating data producing unit of the computer apparatus is the front portion of the conveyed object when seen in the conveyed direction in which the conveyed object is conveyed.

15. The stamp-face forming system according to claim 13, wherein:

the part of the film facing at least one of the edge portions of the stamp face material in which the amount of heat per unit area to be applied to is controlled by the controlling unit of the stamp-face forming apparatus corresponds to front, right and left portions of the conveyed object when seen in a conveyed direction in which the conveyed object is conveyed, and the portion close to the edge portions of the stamp face material with respect to which the additionally-heating data is produced and superimposed on the image data by the additionally-heating data producing unit of the computer apparatus corresponds to the front, right and left portions of the conveyed object when seen in the conveyed direction in which the conveyed object is conveyed.

16. The stamp-face forming system according to claim 13, wherein the stamp-face forming apparatus further comprises:

a size detecting unit which detects a size of the stamp face material of the conveyed object; and the controlling unit of the stamp-face forming apparatus has an error processing unit which ceases a stamp-face forming process and gives notice of ceasing the stamp-face forming process to the computer apparatus through the communication unit, when the size of the stamp face material detected by the size detecting unit does not coincide with a size indicated by the superimposed image-data output from the outputting unit of the computer apparatus.

17. The stamp-face forming system according to claim 16, wherein the computer apparatus further comprises:

an error displaying unit which displays a prompt image for prompting to use a proper size of the stamp face material and to remake the image data for forming the stamp face.

18. The stamp-face forming system according to claim 13, wherein the controlling unit of the stamp-face forming apparatus controls the stamp-face forming unit depending on a time duration in which the amount of heat is applied.

19. The stamp-face forming system according to claim 13, wherein the controlling unit of the stamp-face forming apparatus controls the stamp-face forming unit depending on a voltage at which the amount of heat is applied.

20. The stamp-face forming system according to claim 13, wherein the controlling unit of the stamp-face forming apparatus controls the stamp-face forming unit depending on both a time duration and a voltage, at which the amount of heat is applied.

* * * * *